US005281260A

United States Patent [19]

Kumar et al.

[11] Patent Number: 5,281,260

[45] Date of Patent: Jan. 25, 1994

[54] HIGH-STRENGTH TUNGSTEN CARBIDE MATERIAL FOR USE IN EARTH-BORING BITS

[75] Inventors: Anil Kumar, Sugarland; Larry P. Pelty, Houston, both of Tex.

[73] Assignee: Baker Hughes Incorporated, Houston, Tex.

[21] Appl. No.: 843,823

[22] Filed: Feb. 28, 1992

[51] Int. Cl.[5] ..... C22C 29/08

[52] U.S. Cl. ..... 75/240; 75/242; 175/426; 51/307

[58] Field of Search ..... 75/240, 242; 51/307; 175/426

[56] References Cited

U.S. PATENT DOCUMENTS

| | | | |
|---|---|---|---|
| 2,202,821 | 6/1940 | Balke | 75/241 |
| 2,253,969 | 8/1941 | Dawihl et al. | 384/129 |
| 3,384,465 | 5/1968 | Humenik et al. | 29/182.2 |
| 3,816,081 | 6/1974 | Hale | 6/74 |
| 3,993,446 | 11/1976 | Okawa | 29/182.7 |
| 4,120,719 | 10/1978 | Nomura et al. | 75/238 |
| 4,339,272 | 7/1982 | Grover et al. | 75/240 |
| 4,442,180 | 4/1984 | Hara et al. | 428/551 |
| 4,636,252 | 1/1987 | Yoshimura et al. | 75/238 |
| 4,639,352 | 1/1987 | Kodama et al. | 419/15 |
| 4,903,786 | 2/1990 | Welsh | 175/367 |
| 4,947,945 | 8/1990 | Griffin | 175/409 |
| 5,110,349 | 5/1992 | Westergren et al. | 75/233 |

FOREIGN PATENT DOCUMENTS

| | | | |
|---|---|---|---|
| 203819 | 10/1956 | Australia | 75/240 |
| 559643 | 7/1958 | Canada | 75/240 |
| 1065624 | 9/1959 | Fed. Rep. of Germany | 75/240 |
| 96849 | 6/1983 | Japan | 75/240 |
| 727108 | 3/1955 | United Kingdom | 75/240 |
| 1450654 | 1/1974 | United Kingdom | C22C 29/00 |
| 1572524 | 4/1976 | United Kingdom | C22C 29/00 |

OTHER PUBLICATIONS

Tingle et al., The Effect of Binder Chemistry on the Fracture Toughness of Cemented Tungsten Carbides (Engineering Report from Vermont American Corp.).

Vasel et al., "Binder Deformation in WC-(Co, Ni) Cemented Carbide Composites", Metallurgical Transactions A, vol. 16A, Dec. 1985, pp. 2309-2317.

Peters et al., Properties of Nickel Substituted Hardmetals and Their Performance in Hard Rock Drill Bits, 1985 (Report from Boart Research Centre, South Africa).

Eun et al., "Variation of mechanical properties with Ni/Co ratio in WC-(Co-Ni) hardmetals", Powder Metallurgy 1984, vol. 27, No. 2.

*Primary Examiner*—Donald P. Walsh
*Assistant Examiner*—Ngoclan T. Mai
*Attorney, Agent, or Firm*—Felsman, Bradley, Gunter & Dillon

[57] ABSTRACT

A sintered hard metal compact for use in earth-boring bits comprises 80 to 94% by weight tungsten carbide particles, 5.4 to 18% by weight cobalt particles and 0.6 to 2.0% by weight nickel particles wherein the ratio of cobalt to nickel is approximately 9:1 by weight. These materials are formed according to conventional powder-metallurgy techniques to provide a hard, sintered compact for use in earth-boring bits having superior properties for drilling applications.

3 Claims, 1 Drawing Sheet

HIGH-STRENGTH TUNGSTEN CARBIDE MATERIAL FOR USE IN EARTH-BORING BITS

BACKGROUND OF THE INVENTION

1. Field of the Invention

The present invention relates to sintered hard metal compacts for use in earth-boring bits, specifically to the composition of binder matrix materials for use in such sintered hard metal compacts.

2. Summary of the Prior Art

Sintered hard metal compacts long have been used in earth-boring bits to provide such bits with wear-resistance and increased earth-disintegrating ability. Many of these compacts comprise carbides of the group IVB, VB, VIB, or VIIB metals. The carbides are sintered into solid solution with one or more transition metals selected from group VIII. The transition metals thus form a binder matrix for the carbide particles. Depending on the composition of such a hard metal compact, various desirable mechanical properties, such as fracture-toughness, wear-resistance, and hardness are obtained.

The group VIII transition metal cobalt makes an excellent binder matrix material because it has excellent wetting properties in its liquid state. Its wetting ability permits cobalt to distribute itself better over carbide particles, thus providing an excellent binder matrix material having high toughness. However, cobalt is somewhat rare and more expensive than other metals, and can be difficult to obtain. Therefore, the bulk of recent effort in hard metal technology is to find a substitute for cobalt in the binder matrices of such hard metals.

U.S. Pat. No. 3,245,763, Apr. 12, 1966 to Ohlsson et al. discloses a hard metal alloy having superior qualities even if cobalt is wholly or partly substituted by nickel and/or iron. U.S Pat. No. 3,384,465, May 21, 1968 to Humenik, Jr., et al. discloses a sintered compact of tungsten carbide with a binder matrix of iron and nickel in place of cobalt-based material. U.S. Pat. No. 3,816,081, Jun. 11, 1974 to Hale discloses a hard metal having a binder matrix comprised mostly of iron with addition of up to 15 weight percent cobalt and 20 weight-percent nickel. U.S. Pat. No. 3,993,446, Nov. 23, 1976 to Okawa discloses a hard metal with a binder matrix comprised of nickel and cobalt, preferably in the ratio of 2:1. U.S. Pat. No. 4,947,945, Aug. 14, 1990 to Griffin discloses a cutting element for use in an earth-boring bit having a binder matrix comprising nickel and iron.

Most of the foregoing references disclose compositions directed toward replacement of cobalt in the binder matrices of sintered hard metals while retaining objectively good mechanical properties such as hardness, wear-resistance, and fracture-toughness. None of these materials have proved particularly successful for use as compacts in earth-boring bits.

This lack of success may be attributable to the fact that the cutting dynamics of earth-boring bits, and the loading and wear experienced by sintered hard metal compacts used in such earth-boring bits, are not fully understood. Therefore, the utility of a material quantified only by measured mechanical properties is dubious because the exact combination of desirable mechanical properties for sintered hard metal compacts for use in earth-boring bits also is not fully understood.

It has been found that a hard, sintered compact having a binder matrix comprised of nickel and cobalt yields an improved compact that is well-suited to the demanding environment present in earth-boring bit applications. The present invention employs a ratio of cobalt to nickel in the binder matrix that is substantially higher than that disclosed in the prior art, which is directed toward decreasing the quantity of cobalt in such compacts, as discussed above.

SUMMARY OF THE INVENTION

It is a general object of the present invention to provide a sintered hard metal compact having a binder matrix with desirable physical characteristics for use in earth-boring bit applications.

This and other objects are achieved by providing A sintered hard metal compact for use in earth-boring bits comprising 80 to 94% by weight tungsten carbide particles, 5.4 to 18% by weight cobalt particles and 0.6 to 2.0% by weight nickel particles wherein the ratio of cobalt to nickel is approximately 9:1 by weight. These materials are formed according to conventional powder-metallurgy techniques to provide a hard, sintered compact for use in earth-boring bits having superior properties for drilling applications.

Other objects, features and advantages of the composition of the present invention will become apparent to one skilled in the art with reference to the following description of the preferred embodiment.

DESCRIPTION OF THE PREFERRED EMBODIMENT

Figure 1:
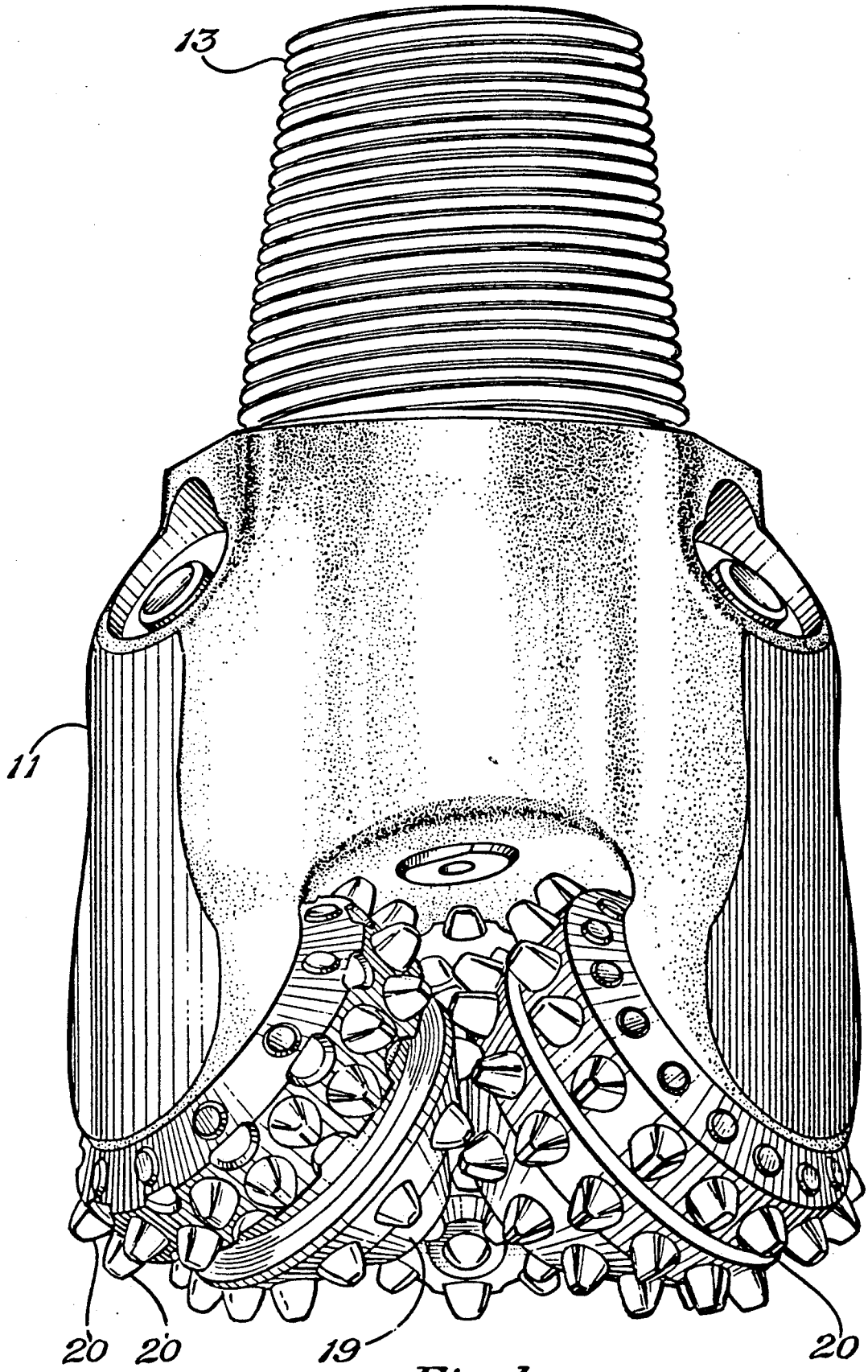
FIG. 1 is a perspective view of an earth-boring bit provided with sintered hard metal compacts according to the present invention.

FIG. 1 shows an earth-boring bit 11 of the rolling cone cutter variety. The bit is threaded at its upper extent 13 for attachment to a drill string (not shown). The bit is provided with at least one cutter cone 19, rotatably mounted upon a bearing shaft (not shown) cantilevered from the bit body (not shown). During drilling operation, the bit 11 is rotated, causing the rolling cutter cones 19 to roll over the bottom of the borehole, crushing and disintegrating the material of the borehole. This crushing and disintegrating action of the cutter cones 19 is enhanced by providing the cones 19 with teeth 20. These teeth 20 often comprise sintered hard metal compacts interference fit into mating sockets in the surface of the cutter cone 19.

The cutting dynamics, and therefore the loading and wear experienced by teeth 20 comprised of sintered, hard-metal compacts are not fully understood. It is generally believed that a sintered hard metal compact for use in a bit 11 should possess the mechanical properties of strength, hardness, abrasion-resistance, and fracture-toughness. However, because the cutting dynamics of such compacts are not fully understood, the precise optimum combination of these properties is unknown.

The present invention provides a sintered, hard metal compact for use in earth-boring bits having an excellent combination of mechanical and metallurgical properties. While the use of hard, sintered compacts in earth-boring bits has been described with reference to bits if the rolling cutter cone variety, the compact of the present invention is equally suited for use in fixed, or non-rolling cone, bits.

Sintered hard metal compacts for use in earth-boring bits generally comprise particles of a carbide material in solid solution with a binder matrix or phase of other material. The carbide particles generally give the compact hardness and abrasion-resistance, while the binder matrix gives the compact fracture toughness that the carbide materials are incapable of providing alone.

Carbide materials for use in such sintered hard metal compacts may be selected from compound of carbide and metals selected form groups IVB, VB, VIB and VIIB of the periodic tables of the elements. Examples of such carbides include, among others: tungsten carbide, tantalum carbide, and chromium carbide.

Binder matrix materials for use in sintered hard metal compacts generally are selected form the transition metals of group VIII of the periodic table of the elements. Cobalt has been found to make an excellent binder matrix material because, in its liquid state, it has superior wetting ability. The wetting ability of cobalt permits it to distribute itself over carbide particles better than other metal, thus providing an excellent low-porosity, high fracture-tough binder matrix material.

Addition of nickel to a cobalt binder matrix has been found to increase the hardness and abrasion resistance of the binder matrix. However, addition of too much nickel can adversely affect the wetting ability of the binder matrix material, thereby increasing the porosity and reducing the fracture-toughness of the sintered hard metal compact.

The present invention provides a cobalt-nickel binder matrix composition for sintered hard metal compacts that is particularly suited for the demanding environment encountered in earth-boring bit applications.

According to the preferred embodiment of the present invention, a sintered hard metal compact for use in earth-boring bits comprises 80–94 weight % tungsten carbide, 5.4–18 weight % cobalt, and 0.6–2 weight % nickel. The relative proportions of these metals should be selected such that the final ratio of cobalt to nickel is approximately 9:1, by weight. An example of a preferred composition according to the present invention is as follows:

| | |
|---|---|
| 84% | WC |
| 14.4% | Co |
| 1.6% | Ni |

All percentages by weight.

The example was prepared in a 200 kilogram batch as follows:

168 kilograms of tungsten carbide particles having a mean diameter of 4.5 microns, 28.8 kilograms of fine powder cobalt, and 3.2 kilograms of fine powder nickel were combined in an attrition mill with 60 liters of acetone-hexane as a solvent. The resulting mixture was milled for four hours at 70 R.P.M. to homogenize the mixture and break the tungsten carbide agglomerate into properly sized particles. Near the end of the milling cycle, 1.8% by weight of paraffin wax was added as a lubricant. This mixture then was vacuum dried at approximately 130°–150° F. for 4–6 hours to remove the acetone-hexane solvent and to distribute the paraffin.

The resulting mixture was processed conventionally into pellets or granules and screened through 20 mesh. The pellets then were pressed at approximately 30,000 psi on an isostatic press, and were vacuum sintered at 1400 +/−10° C. for 80 minutes. The resulting near-final dimension sintered compact then was pressed in a hot <isostatic press furnace at 12,000 +/−2,000 psi at 1300 +/−20° C.

The resulting sintered hard metal compact had a nominal hardness of 87 (Rockwell A scale), a density of 13.9 grams per cubic centimeter, and a coercivity of 90 Oersted. However, in earth-boring bit applications, the measured mechanical and metallurgical properties of a sintered, hard metal compact are not conclusive as to the compact's performance. Compacts according to the present invention were tested twice on a boring mill using a disk of the rock gabbro 44.5 inches in diameter as a test material. The test depth of cut was 0.080 inch, the feed rate was 0.5 inch per revolution, and the gabbro was rotated at 14 R.P.M.

After one test of 60 round-trips through the boring mill the test compacts exhibited no breakage and wear of only 0.008 inch, compared with prior art compacts, which exhibited wear of 0.012 inch after an identical test. After another test round of 60 round-trips, the test compacts exhibited no breakage, and wear of only slightly more than 0.004 inch, compared with prior art compacts, which exhibited wear of 0.009 inch after an identical test. These compacts according to the present invention yielded results remarkably improved over prior-art compacts.

It is believed that the 9:1 ratio (by weight) of cobalt to nickel in the binder matrix of the compact resulted in the outstanding performance. Thus, the ratio of nickel to cobalt of approximately 9:1 is believed to result in a sintered, hard metal compact for use in earth-boring bit applications that is unexpectedly successful.

The present invention has been described with reference to a single example of the preferred embodiment. It should be apparent to those skilled in the art that it is thus not limited, but susceptible to various changes and modifications without departing from the scope of the invention.

We claim:

1. An improved rolling cone earth boring bit comprising:

a bit body;

at least one cantilevered bearing shaft depending from the bit body;

a cutter cone rotatably mounted upon the bearing shaft and having an exterior surface with at least one socket formed therein to receive an insert;

at least one insert formed of a sintered hard metal having tungsten carbide in a binder matrix material, the binder matrix material approximately 90% by weight cobalt, a balance of the binder matrix material nickel.

2. An improved rolling cone earth boring bit comprising:

a bit body;

at least one cantilevered bearing shaft depending from the bit body;

a cutter cone rotatably mounted upon the bearing shaft and having an exterior surface with at least one socket formed therein to receive an insert;

at least one insert formed by sintering together approximately 80 to 94% by weight tungsten carbide, 5.4 to 18% by weight cobalt, and 0.6 to 2.0% by weight nickel, wherein a ratio of cobalt to nickel in the binder matrix material is substantially 9:1 by weight;

at least one insert interference fit into a socket in the cutter cone.

3. The improved rolling cone earth-boring bit according to claim 2 wherein said at least one insert comprises:

84% by weight tungsten carbide;

14.4% by weight cobalt; and a balance nickel.

* * * * *

UNITED STATES PATENT AND TRADEMARK OFFICE

CERTIFICATE OF CORRECTION

PATENT NO. : 5,281,260

DATED : January 25, 1994

INVENTOR(S) : Anil Kumar and Larry P. Pelty

It is certified that error appears in the above-identified patent and that said Letters Patent is hereby corrected as shown below:

At column 3, line 67, delete "<" .

Signed and Sealed this

Fifth Day of July, 1994

*Attest:*

*Attesting Officer*

BRUCE LEHMAN

*Commissioner of Patents and Trademarks*